US005729271A

United States Patent [19]

Makarchuk et al.

[11] Patent Number: 5,729,271

[45] Date of Patent: Mar. 17, 1998

[54] DEVICE TO DESENSITIZE MIGRATION IMAGING FILM AND ALLOW DAYLIGHT FILM HANDLING

[75] Inventors: Irena Makarchuk, Fairfield; Sandra Graveson, Waterbury, both of Conn.; Robert J. Kleckner, Yorktown Hgts., N.Y.; Leo Chin, Bronx, N.Y.; Abu S. Islam, Mt. Vernon, N.Y.

[73] Assignee: Xerox Corporation, Stamford, Conn.

[21] Appl. No.: 434,961

[22] Filed: May 4, 1995

[51] Int. Cl.[6] ..... B41J 2/385; G03G 9/08

[52] U.S. Cl. ..... 347/155

[58] Field of Search ..... 347/156, 153, 347/140, 155

[56] References Cited

U.S. PATENT DOCUMENTS

| | | | |
|---|---|---|---|
| 3,770,554 | 11/1973 | Jones et al. | 156/510 |
| 3,878,816 | 4/1975 | Harris et al. | 118/637 |
| 3,901,699 | 8/1975 | Sankus, Jr. | 96/1 PS |
| 3,918,969 | 11/1975 | Goffe | 96/1 |
| 4,021,110 | 5/1977 | Pundsack | 355/10 |
| 4,076,527 | 2/1978 | Nealy | 96/1 PE |
| 4,278,335 | 7/1981 | Vincett et al. | 354/3 |
| 4,500,621 | 2/1985 | Wurster | 430/72 |
| 4,536,457 | 8/1985 | Tam | 430/41 |
| 4,816,370 | 3/1989 | Croucher et al. | 430/115 |
| 5,411,825 | 5/1995 | Tam | 430/41 |
| 5,530,526 | 6/1996 | Kleckner et al. | 355/219 |
| 5,580,689 | 12/1996 | Chen et al. | 430/41 |
| 5,587,767 | 12/1996 | Islam et al. | 355/27 |

FOREIGN PATENT DOCUMENTS

A-4134236 4/1992 Germany .

*Primary Examiner*—Safet Metjahic
*Assistant Examiner*—Christopher E. Mahoney
*Attorney, Agent, or Firm*—Oliff & Berridge

[57] ABSTRACT

A heating device for desensitizing migration imaging film on an external imaging member scanner. The heating device is curved and has a large surface area to provide maximum heating efficiency. The heating device is mounted to a bracket connected to a scanner cartridge and moves integrally with the scanner cartridge in the direction of the longitudinal axis of the imaging member. The heating device heats the migration imaging film to a temperature to ensure that the surface charge on the film is changed, but is less than a temperature needed for selenium particle migration. As a result, the selenium in the migration imaging film is no longer sensitive under daylight conditions. Thus, the migration imaging film can be removed and heated under daylight conditions providing a significant advantage over film that must be removed and heated under red light conditions.

17 Claims, 1 Drawing Sheet

DEVICE TO DESENSITIZE MIGRATION IMAGING FILM AND ALLOW DAYLIGHT FILM HANDLING

BACKGROUND OF THE INVENTION

1. Field of the Invention

This invention relates to external drum scanners using a desensitizing device to desensitize migration imaging film.

2. Background of Related Art

Migration imaging film is a dry, digital film disposed on the surface of a drum. The film is made sensitive to light by electrostatic charge. In prior art devices, the use of migration imaging film in an external drum scanner requires three steps: 1) charging, 2) laser imaging and 3) heating.

In the first step, the high voltage charging in external drum scanners, for example, can be accomplished by a corotron, scorotron or other charging device. Typically, the charging device is mounted to the scanner cartridge, for example, containing a modulated laser, or other light source. A latent image is created by an image-wise application of light from the modulated laser, or other source. The charging device is positioned so that the charge is applied to the migration imaging film just prior to the exposing of the migration imaging film by the laser.

In the second step, a latent image is made on the migration imaging film using a modulated laser, or other source.

In the third step, a visible image is made to appear when the charged and exposed film is heated in accordance with a known temperature-time relationship.

In prior art devices, charging and laser imaging of the migration imaging film were performed inside the scanner in the dark. After charging and imaging, the migration imaging film is then removed from the scanner and heated. However, because the migration imaging film contains a positive or negative electrostatic charge causing the migration imaging film to be sensitive to light, the removal and heating of migration imaging film is performed under special lighting conditions, such as, red light conditions, which is counter productive and inconvenient.

SUMMARY OF THE INVENTION

It is an object of this invention to provide a device that allows for the removal and heating of migration imaging film in a convenient and practical lighting environment without the need for special lighting conditions.

It is a further object of this invention to provide a device that desensitizes migration imaging film in an external drum scanner application.

Another object of this invention is to provide a film desensitizing device contained within an external drum scanner.

These and other objects of this invention can be achieved by providing a heating device for desensitizing the film by changing the surface charge of the film. The heating device moves integrally with the scanner cartridge along the longitudinal axis of the drum to heat the film by radiant heating. To provide maximum heating efficiency, the heating device is curved to have an inside diameter approximately equal to the diameter of the drum. A shield is provided to prevent overheating of scanner interior components by the heating device.

These and other aspects and advantages of this invention are described or apparent from the following detailed description of the preferred embodiments.

BRIEF DESCRIPTION OF THE DRAWINGS

The preferred embodiments are described with reference to the drawing in which.

DETAILED DESCRIPTION OF THE PREFERRED EMBODIMENTS

Figure 1:
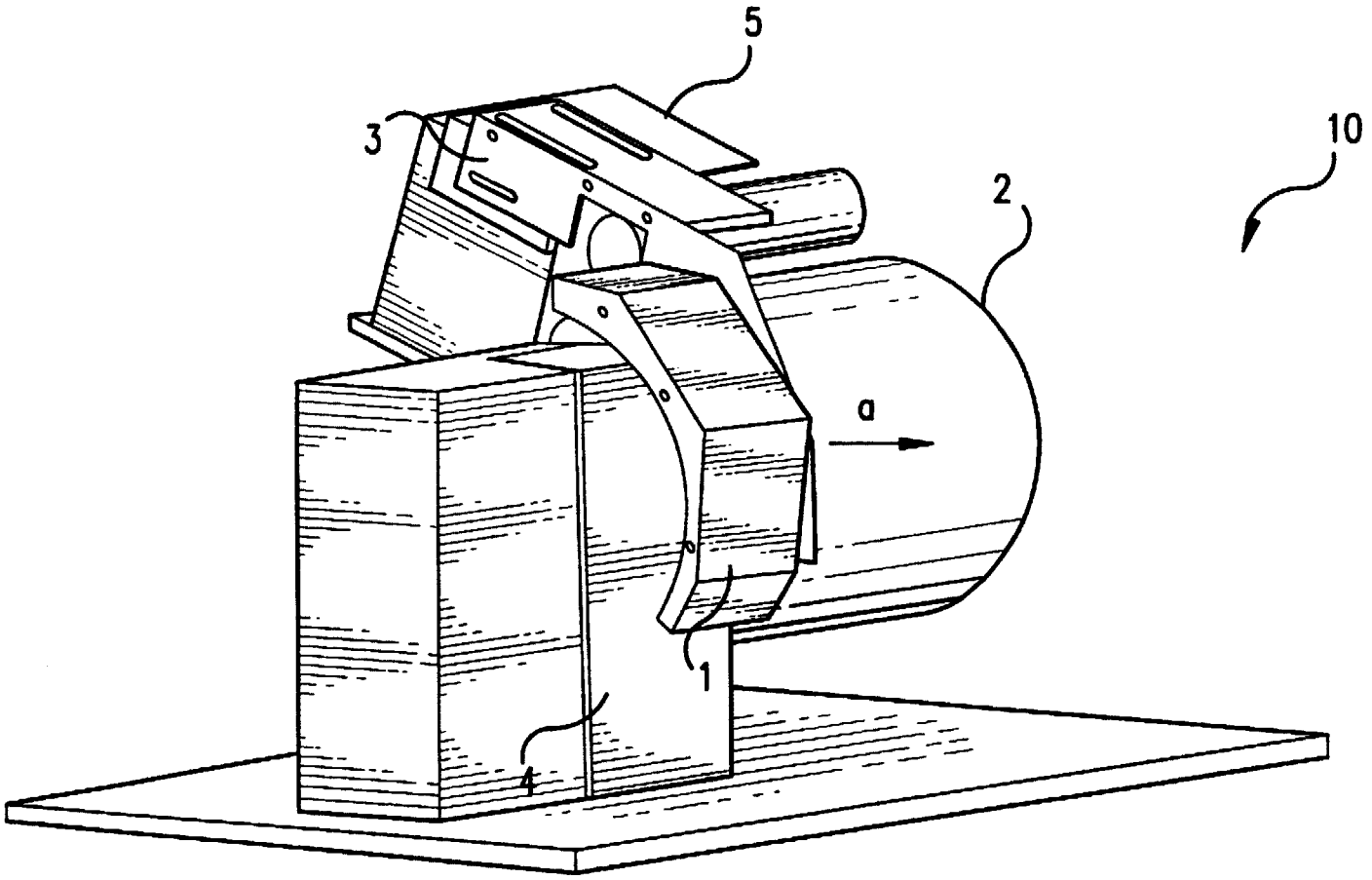
FIG. 1 is a perspective view of the preferred embodiment of the invention.

FIG. 1 shows a scanning device 10 comprising a heating device 1, mounted to a scanner 5 using a bracket 3. A shield 4 is provided to prevent heating means 1 from over heating the interior components of the scanner 10. Film, such as migration imaging film, is disposed on the surface of an imaging member 2, which may be, for example, a drum having a longitudinal axis in the direction of arrow a.

The migration imaging film is exposed by the scanner 5. It may be appreciated that the scanner 5 may be any suitable device that contains a modulated laser, or other source to create a latent image on the film. The scanner 5 may also contain, for example, a modular arc charger as described in a coassigned U.S. Pat. No. 5,530,526, entitled "Modular Charging Device For Imaging" and incorporated herein by reference.

As the image is exposed on the migration imaging film by the scanner 5, the heating device 1 is moved integrally with the scanner 5 in a direction along the longitudinal axis of the imaging member 2 indicated by the arrow a. As the heating device I is moved integrally with the scanner 5, the heating device 1 heats the migration imaging film disposed on the imaging member 2 to a low-level temperature of approximately 70° C.

When the heating device 1 heats the migration imaging film surface to approximately 70° C., the surface charge on the film changes. As a result, the selenium contained in the migration imaging film is no longer sensitive to daylight conditions. Because the film temperature is maintained at a temperature less than the temperature needed for selenium particle migration, areas of Drain are unaffected. It may be understood that, instead of selenium, any suitable marking material for particle migration may be used, such as, tellurium, antimony, thallium, bismuth, or mixtures thereof.

In order to be properly desensitized, the migration imaging film should retain a low surface charge after the heat from heating device 1 is discharged. For example, the migration imaging film on the imaging member 2 should retain a charge of approximately −60 volts after the heat from heating device 1 is discharged.

In order to increase the heating efficiency of the heating device 1, the heating device 1 is curved with an inside diameter approximately equal to the outside diameter of the imaging member 2. Furthermore, because a larger surface area of the heating device 1 can desensitize the migration imaging film easier, the length and width of the heating device 1 should be designed to provide the maximum heating efficiency for each external imaging member architecture.

The migration imaging film on the imaging member 2 may be heated by radiant heat emitted by heating device 1. However, it can be understood that heating device 1 is not limited to a device that emits radiant heat but may be any device capable of removing a positive or negative charge from the film surface. Other devices capable of removing a positive or negative charge from the film surface may be used, such as, a hot air device to heat the film surface, a positive charger to cancel a negative charge on the film surface, a negative charger to cancel a positive charge on the film surface, a grounded brush to remove charge from the film surface and a laser to heat the film surface.

It may be understood that the imaging member 2 can be any suitable imaging member, such as, a web, a foil, a laminate, a strip, a sheet, a coil, a cylinder, an endless belt, an endless mobius strip, a circular disc, or any other suitable form. Furthermore, it may be understood that the film disposed on the surface of the imaging member 2 may be any suitable migration imaging material sensitized by exposure to electromagnetic energy.

Once the film has become desensitized to daylight conditions by heating device 1 while on the imaging member 2, the migration imaging film can be removed from the scanning device and processed by a heater (not shown) under daylight conditions. A method of heat-developing migration imaging film using radiant energy, for example, is described in a coassigned U.S. Pat. No. 5,587,767entitled "Digital Film Heat Processor and Method" and incorporated herein by reference. As a result, the removal and heating of migration imaging film in a scanning device is practical and convenient.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A device for desensitizing migration imaging film, comprising:

an imaging member having the film disposed on an outer surface;

a scanner for exposing the film; and a desensitizing device for desensitizing the film by changing a surface charge on the film without causing migration of the migration marking particles.

2. The device according to claim 1, wherein the desensitizing device is mounted on a bracket connected to the scanner, the desensitizing device moving integrally with the scanner.

3. The device according to claim 2, wherein the imaging member is a drum.

4. The device according to claim 3, wherein the drum has a longitudinal axis, the desensitizing device and the scanner move integrally along the longitudinal axis of the drum.

5. The device according to claim 3, wherein the desensitizing device is curved having an inside diameter approximately equal to a diameter of the drum.

6. The device according to claim 1, wherein the film is migration imaging film.

7. The device according to claim 1, wherein the scanner is an external drum scanner.

8. The device according to claim 1, wherein the desensitizing device is a heater.

9. The device according to claim 8, wherein the heater is a radiant heater.

10. The device according to claim 9, wherein the radiant heater heats the film to a temperature up to approximately 70° C., wherein the migration of migration marking particles occurs at a temperature above approximately 70° C.

11. The device according to claim 8, further comprising a shield for preventing overheating interior components of the scanner by the heating device.

12. A method for desensitizing migration imaging film, comprising the steps of:

disposing film on an imaging member;

exposing the film using a scanner;

desensitizing the film using a desensitizing device to desensitize the film by changing a surface charge on the film without causing migration of the migration marking particles.

13. A device for desensitizing film, comprising:

an imaging member having the film disposed on an outer surface;

a scanner for exposing the film; and a heating device mounted on a bracket connected to the scanner and moving integrally with the scanner for desensitizing the film by changing a surface charge on the film.

14. The device of claim 13, wherein the imaging member is a drum.

15. The device of claim 14, wherein the drum has a longitudinal axis, the heating device and the scanner move integrally along the longitudinal axis of the drum.

16. The device of claim 14, wherein the heating device is curved having an inside diameter approximately equal to the diameter of the drum.

17. A device for desensitizing film, comprising:

an imaging member having the film disposed on an outer surface;

a scanner for exposing the film;

a heating device mounted on a bracket connected to the scanner and moving integrally with the scanner for desensitizing the film by changing a surface charge on the film; and a shield for preventing overheating of interior components of the scanner by the heating device.

* * * * *